United States Patent [19]

Johnson et al.

[11] Patent Number: 4,599,941

[45] Date of Patent: Jul. 15, 1986

[54] APPARATUS FOR CRUSHING CONTAINERS

[75] Inventors: Ronald C. Johnson; Rex M. Johnson, both of Mahopac; Henry Jankowiak; Thomas J. Morley, both of Suffern; Robert P. Dingwall, Mahopac; Henry R. Heimerich, Lynbrook, all of N.Y.

[73] Assignee: Boro Recycling, Inc., Brooklyn, N.Y.

[21] Appl. No.: 675,138

[22] Filed: Nov. 27, 1984

[51] Int. Cl.[4] ..... B30B 9/32

[52] U.S. Cl. ..... 100/215; 100/218; 100/229 R; 100/295; 100/902

[58] Field of Search ..... 100/902, 215, 218, 229 R, 100/295; 194/4 C

[56] References Cited

U.S. PATENT DOCUMENTS 3,437,033 4/1969 Day ..... 100/215
4,248,334 2/1981 Hanley ..... 100/902 X
4,469,212 9/1984 DeWoolfson ..... 100/902 X
4,499,824 2/1985 Elwing ..... 100/902 X

FOREIGN PATENT DOCUMENTS 0020000 2/1981 Japan ..... 100/215

*Primary Examiner*—Billy J. Wilhite
*Attorney, Agent, or Firm*—George J. Brandt, Jr.

[57] ABSTRACT

Crushing apparatus for crushing containers which includes a tray on which the container is received and which can be positioned along side the housing of a crushing unit. A wiper panel is operated to move the container off the tray and into the crushing unit and onto a lower crushing platen. An upper crushing platen is then stroked down to crush the container. Following crushing, the lower platen is slid away from the crushing unit housing and the crushed container falls to a collection location.

3 Claims, 7 Drawing Figures

APPARATUS FOR CRUSHING CONTAINERS

BACKGROUND OF THE INVENTION AND BRIEF DESCRIPTION

Some states now require refundable deposit be paid when purchasing certain classes of beverages with the aim and purpose that the empty container must be returned to a redemption operation to obtain the refund. In such manner, proper environmental disposition can be made of the used container leading to a lessening of the problem of environmental blight caused by random discard of the empty container.

The present invention provides crushing apparatus which conveniently can be embodied in a structure to be disposed at a redemption center and in appearance quite similar to the vending machines from which a user can purchase a beverage such as a can of soda. This structure or reverse vending machine would allow for a user to insert the used container onto a tray, the container would then be scanned and identified, e.g., reading the bar code and if acceptable for redemption, taken into the machine for destruction and refund of coin or script issued from the machine to the user.

The crushing apparatus of the invention includes the tray on which the container is received. The tray can be operated to move it rearwardly a distance to proximity with a scanner which reads the container bar code. If the container is acceptable, a wiper arm moves the container off the tray and into the housing of a crushing unit, the transfer being onto a lower or base platen member of the crushing unit. The empty tray is moved forwardly to its original position and a hydraulic ram carrying an upper crushing platen is stroked downwardly to crush the container. The crushing platen then can be stroked upwardly and the lower platen which is a slidably mounted member stroked to move it to a position remote from the housing. In moving to said remote position, the lower platen moves beneath a housing wall lower edge of closely conforming shape to that of the lower platen upper surface and there is thereby caused a wiping from the lower platen of the crushed container and any debris which falls to a collection chute disposed below the crushing unit housing. The collection chute is rotatably supported and can be positioned to discharge to a select one of a number of collection bins such as ones for glass, aluminum, PET, etc.

BRIEF DESCRIPTION OF THE DRAWINGS

Throughout the following description, like reference numerals are used to denote like parts in the drawings.

DETAILED DESCRIPTION

Figure 1:
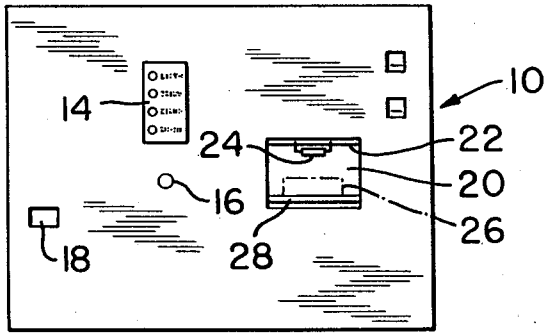
FIG. 1 is an elevational view of machine which can be used for redemption of containers and embodying the crushing apparatus of the present invention.
Figure 4:
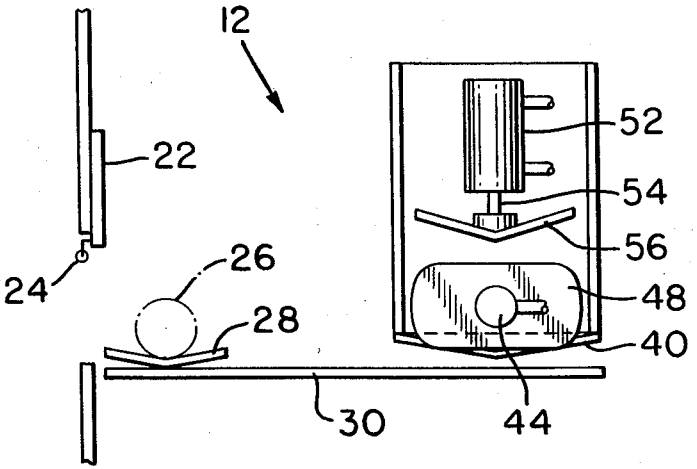
FIG. 4 is a right end elevational schematic view of the apparatus.

FIG. 1 is the front side of a reverse vending machine 10 of the type in which the crushing apparatus 12 of the present invention can be embodied, the machine 10 having a user instruction plate 14, operating button 16, coin refund slot 18 or a tape script release slot if script be refunded in lieu of cash. It also is provided with opening 20 which can be closed off with a door 22 which the user lowers by means of handle 24 after inserting used container 26 on tray 28. By suitable means not shown, and after the door 22 has been closed, the operation of identifying and accepting or rejecting the container 26 for redemption begins. If same is acceptable, the crushing operation will follow in a matter of a few seconds, the refund made by means not shown, and the machine recycled for the next container redemption operation. The crushing apparatus and its operation now will be described with continuing reference to FIGS. 2–7.

Figure 2:
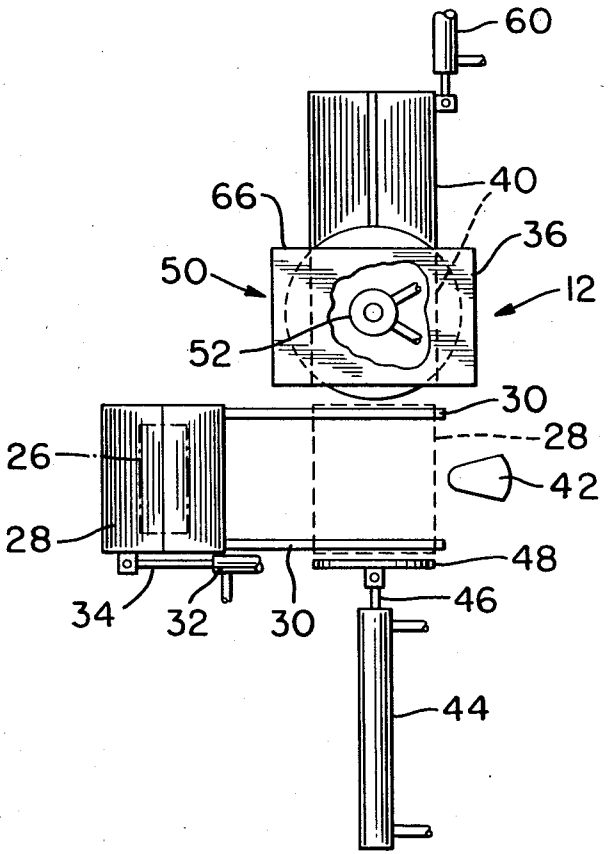
FIG. 2 is a top schematic view of the crushing apparatus.
Figure 7:
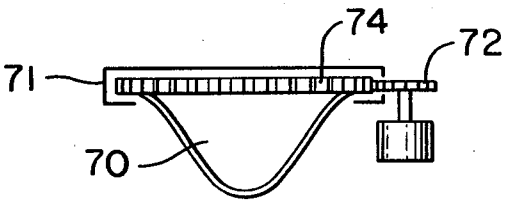
FIG. 7 is a schematic elevational view depicting the discharge chute which is disposed beneath the crushing unit.
Figure 3:
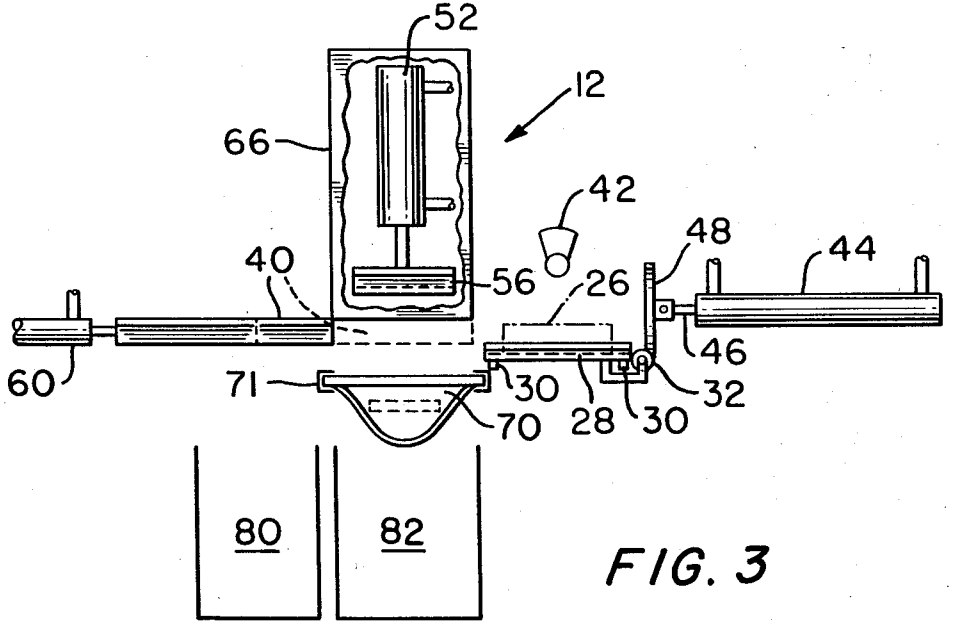
FIG. 3 is a front elevational schematic depiction of the apparatus.
Figure 6:
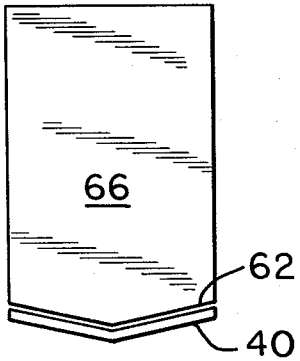
FIG. 6 is a side elevational view of the crushing unit from the side opposite that shown in FIG. 5.
Figure 5:
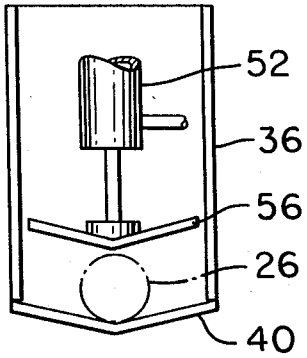
FIG. 5 is a side elevational view of the crushing unit showing the manner in which the container is disposed on the lower platen, the upper platen being in a down stroke mode just about to strike and start crushing the container.

In FIG. 2, the container 26 is on tray 28 and tray 28 is in its front position, the tray being slidable on track 30 to a rearward position shown in dashed lines, sliding being effected with cylinder 32, the rod 34 of which is connected to the tray. As soon as door 22 is closed, tray 28 is slid to the rearward position in which position it is aligned adjacent an open side of crushing unit housing 36. Also and by suitable control (not shown), a lower base platen 40 forming part of the crushing unit is slid from a position remote from housing 36 to the underside thereof, the movement from remote to bottom positions of the housing being depicted by the respective solid and dashed line shown in FIG. 3. With tray 28 in rearward position, it is disposed proximate a scanning unit 42 which by electronic sensing and computer resolution identifies the container 26. If the container is one which should not be redeemed, tray 28 will be slid forwardly and the user directed by message at the front of the machine to remove same. If the container is identified as one to be redeemed, suitable signal generation and control will cause cylinder unit 44 to operate, the stroke of its rod 46 moving wiper panel 48 across tray 28 and thereby transferring the container 26 onto lower platen 40 within crushing unit 50. Rod 46 will immediately retract to clear unit 50 for operation to crush the container. Disposed within crushing unit 50 is a cylinder unit 52 to the rod 54 of which is connected a V-shaped crushing or upper platen unit 56 which will rapidly descend and crush container 26, depicted as an aluminum can, into a flat shape thereby destroying its shape so as to preclude any further possibility that the container could be twice redeemed. FIG. 5 shows the crushing operation just as the upper platen 56 is about to contact the container during its downward descent. Immediately following the crushing operation, lower platen 40 is retracted by operation of cylinder unit 60 to move it to a position remote from housing 36. During that travel, the V-shaped upper surface of platen 40 is caused to pass in closely conforming proximity to the like configured lower edge 62 of wall 66 of housing 50, and thereby cause wiping of the crushed container and any debris from the platen and such container and debris fall onto discharge chute 70 positioned below the crushing unit. FIGS. 3 and 7 show how the discharge chute 70 can be mounted in a frame 71 to be rotatable and by suitable pinion gear 72, and ring gear 74 on the chute or a like arrangement, the chute can be rotated to position it to discharge into a particular one of the collection bins 80, 82 associated for example with glass or aluminum or PET, with the chute orientation being effected by control output based on identification of the container type by the scanner and being effected before crushing.

While there are disclosed only certain embodiments of the crushing apparatus of this invention, it will be appreciated that modifications and variations may be made therein without desparting from the scope of the inventive concept disclosed.

What is claimed is:

1. Apparatus for crushing containers comprising a tray for receiving a container to be crushed, a crushing unit, means for positioning said tray in a container presenting disposition adjacent said crushing unit, means for transferring said container from said tray to said crushing unit, said crushing unit including a base platen receptive of a transferred container, and a crushing platen moveable in a downward direction from a first retracted position above said base platen to a second lowered position during which movement said upper platen crushes said container, said crushing unit including a housing having a top and a bottom and said base platen is slidable from a position wherein it is disposed at the bottom of said housing to a location remote from said housing, said housing including a side wall having a lower edge closely conforming with the surface shape of said base platen whereby during sliding travel of said base platen to said remote location said housing side wall lower edge will effect sweeping of crushed container debris from the surface of said base platen.

2. The apparatus of claim 1 further comprising a discharge chute disposed below said crushing unit housing for receiving any debris swept from the surface of said base platen, said chute being rotatable to selectively position same for discharge of debris to any one of plural collection units disposed therebelow.

3. The apparatus of claim 1 in which said tray is slidable from a first container receiving location to a second location wherein said tray aligns with a side entry opening in said crushing unit, the means for transferring the container from the tray to the crushing unit including a wiper panel and means for stroking said wiper panel across said tray to displace said container therefrom and onto said base platen.

* * * * *